US008667639B2

(12) United States Patent
Richardson

(10) Patent No.: US 8,667,639 B2
(45) Date of Patent: Mar. 11, 2014

(54) VACUUM CLEANER PROVIDING FILTER-ABSENCE DETECTION

(75) Inventor: Ross Richardson, Auchterarder (GB)

(73) Assignee: Hoover Limited, Mid Glamorgan (GB)

( * ) Notice: Subject to any disclaimer, the term of this patent is extended or adjusted under 35 U.S.C. 154(b) by 1225 days.

(21) Appl. No.: 11/428,062

(22) Filed: Jun. 30, 2006

(65) Prior Publication Data

US 2007/0006417 A1 Jan. 11, 2007

(30) Foreign Application Priority Data

Jul. 7, 2005 (GB) ..... 0514014.0

(51) Int. Cl.
*A47L 9/10* (2006.01)

(52) U.S. Cl.
USPC ..... 15/347; 15/412

(58) Field of Classification Search
USPC ..... 15/347, 412
See application file for complete search history.

(56) References Cited

U.S. PATENT DOCUMENTS

| | | | | |
|---|---|---|---|---|
| 4,044,421 | A * | 8/1977 | Kristenson et al. | 15/339 |
| 4,213,224 | A * | 7/1980 | Miller | 15/344 |
| 4,512,057 | A * | 4/1985 | Laing et al. | 15/320 |
| 4,586,214 | A * | 5/1986 | Berfield | 15/327.5 |
| 4,613,348 | A * | 9/1986 | Natale | 55/318 |
| 5,102,435 | A * | 4/1992 | Rau et al. | 55/467 |
| 5,160,356 | A * | 11/1992 | Dyson | 55/345 |
| 5,388,302 | A * | 2/1995 | Sundaram et al. | 15/344 |
| 5,593,470 | A * | 1/1997 | Shagott et al. | 96/418 |
| 6,085,382 | A * | 7/2000 | Bobrosky et al. | 15/350 |
| 6,269,518 | B1 * | 8/2001 | Yung | 15/352 |
| 6,289,553 | B1 * | 9/2001 | Dyson | 15/347 |
| 6,311,366 | B1 * | 11/2001 | Sepke et al. | 15/412 |
| 6,553,611 | B2 * | 4/2003 | Huebsch et al. | 15/339 |
| RE38,949 | E * | 1/2006 | Wright et al. | 15/347 |
| 7,118,607 | B2 * | 10/2006 | Bott et al. | 55/374 |
| 7,676,884 | B2 * | 3/2010 | Mayes et al. | 15/347 |
| 2003/0037405 | A1 * | 2/2003 | Moine et al. | 15/352 |
| 2003/0140446 | A1 * | 7/2003 | Park et al. | 15/351 |
| 2004/0060146 | A1 * | 4/2004 | Coates et al. | 15/347 |
| 2004/0068828 | A1 * | 4/2004 | Bair et al. | 15/353 |

(Continued)

FOREIGN PATENT DOCUMENTS

| | | |
|---|---|---|
| EP | 0895744 | 2/1999 |
| EP | 1214903 | 6/2002 |

(Continued)

*Primary Examiner* — Lee D Wilson
*Assistant Examiner* — Shantese McDonald
(74) *Attorney, Agent, or Firm* — Gordon & Jacobson, PC

(57) ABSTRACT

A vacuum cleaner having a filter assembly 12 disposed on grill 16 between the bag chamber 7 and motor chamber 13. Bag chamber 7 has a cover 8. Filter assembly 12 has an upstanding wall 15 provided with a covering of resilient material, e.g. rubber. The cover 8 is formed with a grill 14 in a lower region. When the filter assembly is correctly installed, and the cover 8 is in position, the resilient covering of the upstanding wall 15 rests in sealing contact against the inner surface of the cover 8 and over the grill 14. If the filter assembly 12 is absent, the grill 14 provides direct fluid communication between the bag chamber 7 and the atmosphere. The cleaner will be ineffective in picking up dirt thereby alerting the user to the absence of the filter assembly.

14 Claims, 4 Drawing Sheets

(56) References Cited

U.S. PATENT DOCUMENTS

| | | | | |
|---|---|---|---|---|
| 2004/0088819 | A1* | 5/2004 | Hafling et al. | 15/347 |
| 2004/0128790 | A1* | 7/2004 | Mudd | 15/353 |
| 2004/0206238 | A1* | 10/2004 | Allgeier | 95/273 |
| 2005/0183232 | A1* | 8/2005 | Wright et al. | 15/347 |
| 2005/0217066 | A1* | 10/2005 | Bair et al. | 15/347 |
| 2005/0229356 | A1* | 10/2005 | Blocker et al. | 15/412 |

FOREIGN PATENT DOCUMENTS

| | | |
|---|---|---|
| GB | 2137896 | 10/1984 |
| GB | 2092472 | 8/1992 |
| GB | 2403646 | 1/2005 |
| WO | WO03-007775 | 1/2003 |
| WO | WO2005/099544 | 10/2005 |

* cited by examiner

VACUUM CLEANER PROVIDING FILTER-ABSENCE DETECTION

BACKGROUND OF THE INVENTION

1. Field of the Invention

The present invention relates to a vacuum cleaner and more particularly to a vacuum cleaner which enables the user to detect when a filter unit of the cleaner is absent.

2. State of the Art

Modern vacuum cleaners generally operate on a "clean-air fan" principle, according to which the airflow through the cleaner is created by a fan located in the airstream at a point downstream of the separator arrangement which removes dirt and dust from the incoming suction airflow. Dirty air is drawn into the cleaner through a floor-engaging nozzle or other suction inlet and passes through a conduit to the separator arrangement, connected in fluid communication with the inlet of the fan. The airflow thus passes through the separator arrangement and the fan, and is then expelled from the cleaner, to ambient, through an exhaust outlet. The separator arrangement may take any one of several forms, of which filter bags and cyclone separators are the most common, although other arrangements including rigid porous dirt containers are also known. In conventional vacuum cleaner fan systems, the fan and the electric motor which drives the fan are integrated into a compact unit in which the air leaving the fan passes over the motor to effect cooling of the motor. It will be appreciated that should the separator arrangement fail effectively to remove dirt and impurities from the airflow before this airflow reaches the fan, then this dirt could cause damage to the fan and its motor. For this reason it is conventional to provide an additional stage of filtration between the separator arrangement and the inlet to the fan, this additional filtration stage generally being known as the pre-motor filter.

Since pre-motor filters must be removed from the cleaner periodically for cleaning or renewal, it will be appreciated that situations can arise where the user operates the cleaner with the pre-motor filter absent. This is clearly undesirable, and a number of arrangements have been proposed hitherto for preventing the occurrence of such situations. For example, European patent application EP 0,895,744 discloses an arrangement in which the presence of the pre-motor filter is detected by an electronic scanning system: an electronic sensing device is mounted on the body of the vacuum cleaner and co-operates with a sensing element attached to the filter to produce a signal dependent on the presence or absence of the filter, or indeed on the presence of the correct type of filter and/or its correct installation in the cleaner; the signal may be used to initiate a filter-absent warning to the user and/or to prevent the fan motor from starting. This filter-presence detection system is complicated and is expensive to manufacture, rendering it unsuitable for simple low-cost products.

A number of other detection systems have been proposed, for detecting the presence or absence of the pre-motor filter, based on the principle of preventing the use of the cleaner unless the cover which closes the separation chamber is correctly installed. A typical arrangement of this type is disclosed in European patent application EP 1,214,903, in which correct installation of the filter results in a spring-loaded tongue being withdrawn from a position in which it would obstruct closure of the dirt receptacle: without the dirt receptacle being properly closed, the cleaner cannot function. This and other mechanical arrangements are generally complicated and increase the manufacturing costs unduly.

SUMMARY OF THE INVENTION

We have now devised arrangements which are of simple and inexpensive construction, for indicating to the user when a filter of the cleaner is absent and preventing the cleaner from being used with the filter absent, whilst maintaining a flow of clean air over the fan motor to effect cooling.

In accordance with the present invention, there is provided a vacuum cleaner which includes a filter assembly or unit arranged for a part thereof to occlude at least one aperture provided in the structure of the cleaner and through which, in the absence of the filter assembly or unit, the suction airflow path of the cleaner is in fluid communication with ambient.

In use of this vacuum cleaner, should the filter assembly or unit be absent, air is drawn in from ambient through the at least one aperture, rather than along the suction path from the suction nozzle or other suction inlet of the cleaner. The cleaner is thus ineffective in picking up dirt through the suction inlet and this situation is immediately apparent to the user, and must be remedied by replacing the filter assembly.

Preferably said at least one aperture is arranged (typically as a result of the dimensions of the aperture or apertures and of its location) so that, in the absence of said filter assembly, the majority of the suction airflow entering the cleaner does so through said at least one aperture.

Preferably the filter assembly is located to provide a filtration stage between the main separation stage of the cleaner and the inlet to the suction fan. The main separation stage comprises a separator, typically in the form of a filter bag, disposed in a chamber to which the fan applies a suction.

The filter assembly preferably comprises a filter element mounted to or in a supporting structure (for example in the form of an open frame) a part of which forms the part of the assembly which occludes said at least one aperture in the structure of the cleaner, when the filter assembly is installed in the cleaner. Preferably said part of the filter supporting structure comprises a projecting part of that structure. Preferably this projecting part fits sealingly into, or seats sealingly over, said at least one aperture.

Preferably said at least one aperture is formed in a wall of the chamber in which the filter bag or other separator unit is disposed, and is preferably formed in a detachable or hinged cover of that chamber.

Preferably said at least one aperture is provided by a grill which comprises an array of openings.

In an embodiment which will be described herein, the filter assembly is removably disposed within the cleaner across the suction airflow path therethrough, for the air to pass through the filter as it passes along an internal conduit of the cleaner: said at least one aperture is formed through the structure of the cleaner, to ambient, adjacent the filter assembly, so that should the filter assembly be absent, air is drawn in from ambient through said at least one aperture, instead of being drawn into the cleaner from a suction nozzle or other suction inlet and along said conduit.

Also in accordance with the present invention, there is provided a filter assembly for a vacuum cleaner, the filter assembly comprising a filter element for the suction airflow to pass through, and a part arranged to occlude at least one aperture formed in the structure of the cleaner and communicating with ambient. Preferably said part of the filter assembly is provided with a sealing means for sealing against said structure of the cleaner, around said at least one aperture.

An embodiment of the present invention will now be described by way of example only and with reference to the accompanying drawings.

DETAILED DESCRIPTION OF THE PREFERRED EMODIMENTS

Figure 1:
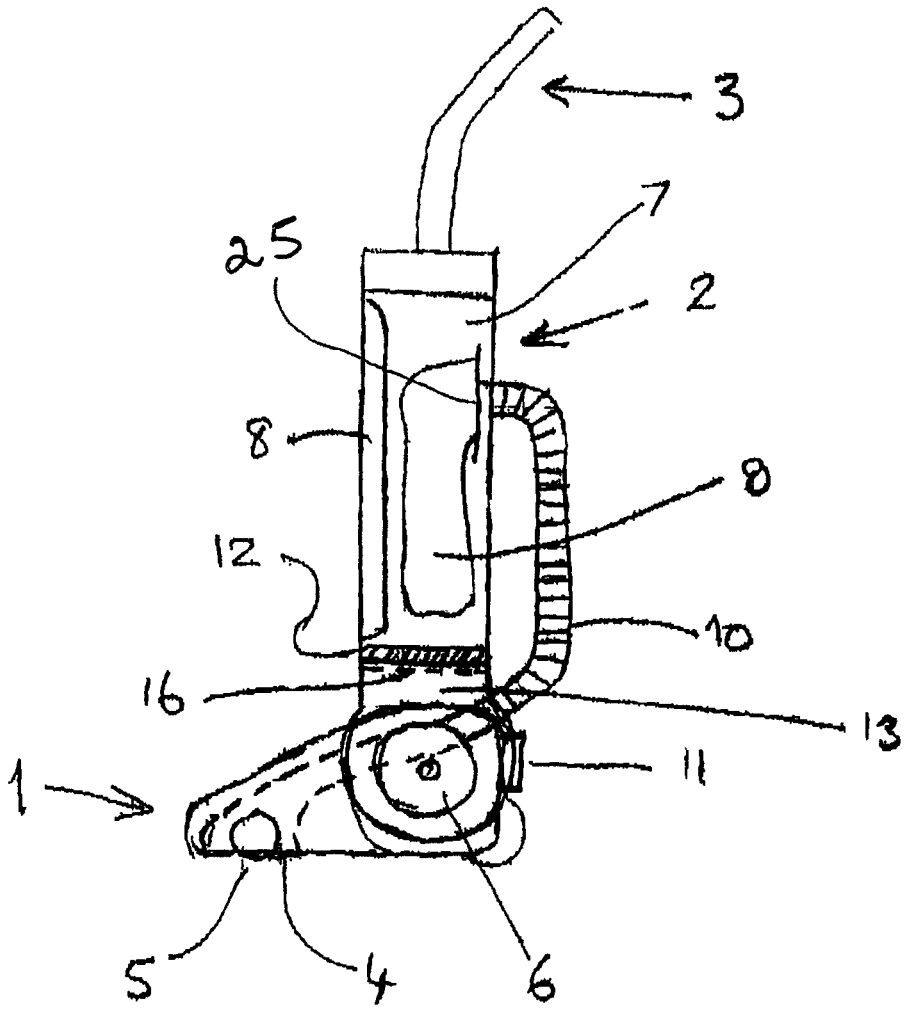
FIG. 1 is a schematic view of a prior art vacuum cleaner of the upright type.

Referring firstly to FIG. 1 of the drawings, there is shown a conventional vacuum cleaner of the upright type, comprising a floor-engaging foot or base unit 1 to which an upright body 2 is pivotally mounted. The floor-engaging unit 1 is provided on its underside with a suction mouth or inlet 4 in which a rotating brush 5 is disposed. The upright body 2 comprises a housing which is divided into two chambers, namely the bag chamber 7 which is closed by a removable cover 8 and, in use, encloses a porous filter bag 9, and a motor chamber 13 in which a motor/fan unit 6 is mounted.

The motor chamber 13 is divided into two separate regions, one in fluid communication with the bag chamber 7 via a grill 16, and the other in fluid communication with an exhaust-air outlet 11. The grill 16 comprises a wall or partition formed with an array of openings and, in the example shown, effectively forms the floor of the bag chamber 7 and supports a filter element 12 which is disposed on the upper or upstream side of the grill 16.

In operation, the motor/fan unit 6 applies suction to the bag chamber 7, generating an airflow from the bag chamber 7 and out through the exhaust outlet 11. The resulting negative pressure in the bag chamber 7 gives rise to a flow of air from the suction inlet 4 to the interior of the bag 9 via a duct 10, which is operably coupled to the bag 9 via aperture 25 disposed within the bag chamber as shown in FIG. 1. Having passed through the filter bag 9, the clean air passes through the pre-motor filter 12 and enters the motor chamber 13 by way of the grill 16.

Figure 2:
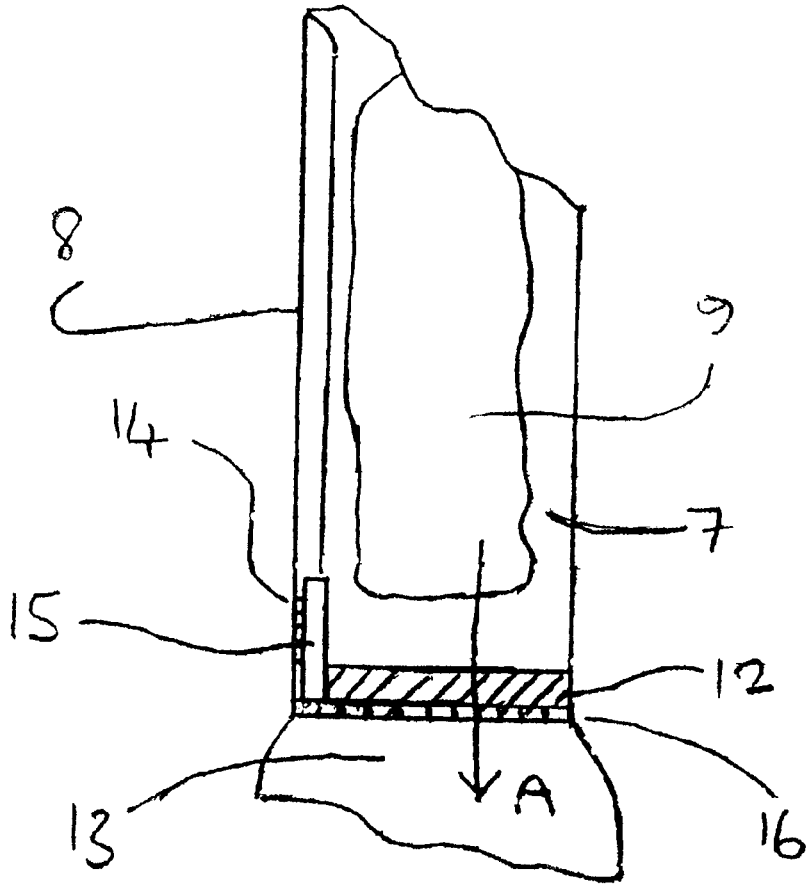
FIG. 2 is a schematic sectional view of the lower region of the bag chamber of an upright vacuum cleaner in accordance with the present invention, and shown with the pre-motor filter unit present.

Referring now to FIG. 2 of the drawings, a vacuum cleaner in accordance with the present invention corresponds with the above-described cleaner of FIG. 1 but with the following modification. Thus, the pre-motor filter comprises an assembly 12 of generally planar form, supported on the grill 16, but having an upstanding wall 15 extending along its forward edge. The front surface of the upstanding wall 15 is provided with a covering of resilient material for seating against the inner surface of the bag chamber cover 8, when the filter assembly is correctly installed and the cover 8 is fitted to close the bag chamber. The cover 8 is formed, in a lower region thereof, with a grill 14 the apertures through which are occluded by the upstanding wall 15 of the filter assembly 12, the covering of resilient material on the upstanding wall 15 serving to seal against the cover 8 around the periphery of the grill 14. It will be appreciated that when the filter assembly 12 is correctly installed and the cover 8 is closed, as shown in FIG. 2, then the fan creates an airflow in the cleaner, indicated by the arrow A in FIG. 2, which leaves the filter bag 9, passes through the pre-motor filter assembly 12 and enters the motor chamber 13 through the grill 16.

Figure 3:
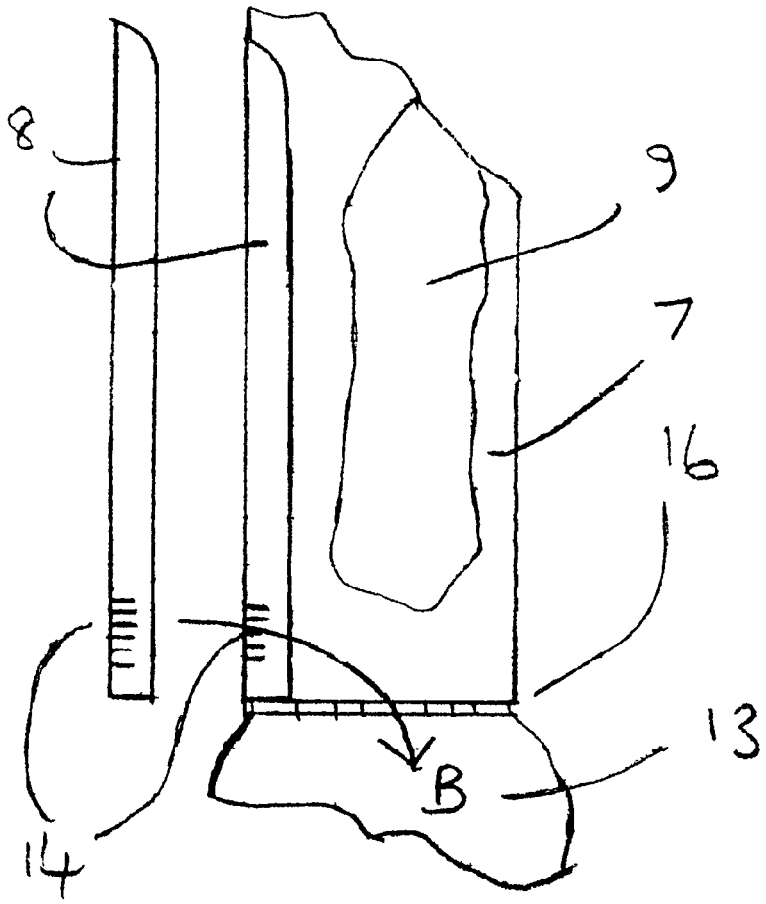
FIG. 3 is a similar view of the lower region of the bag chamber, shown with the pre-motor filter absent.

Should however the filter assembly 12 be absent from the cleaner, as shown in FIG. 3, then the bag chamber 7 will be in direct fluid communication with the atmosphere by way of the grill 14 of the bag chamber cover 8. It will be appreciated that, in this situation, the fan will draw in air from the exterior of the cleaner, through the grill 14 of the cover 8, and directly into the motor chamber 13, as indicated by the arrow B in FIG. 3. The bag chamber 7 will not be evacuated or subjected to any significant suction and no flow of air will occur from the floor-engaging suction inlet or nozzle of the cleaner: the cleaner will therefore be ineffective in picking up dirt. This condition will immediately be apparent to the user, who can then remedy it by replacing the filter assembly. Whilst the filter assembly is absent from the cleaner, only clean air is drawn into the motor chamber 13, over the path B, so avoiding potential damage to the motor/fan unit.

Figure 4:
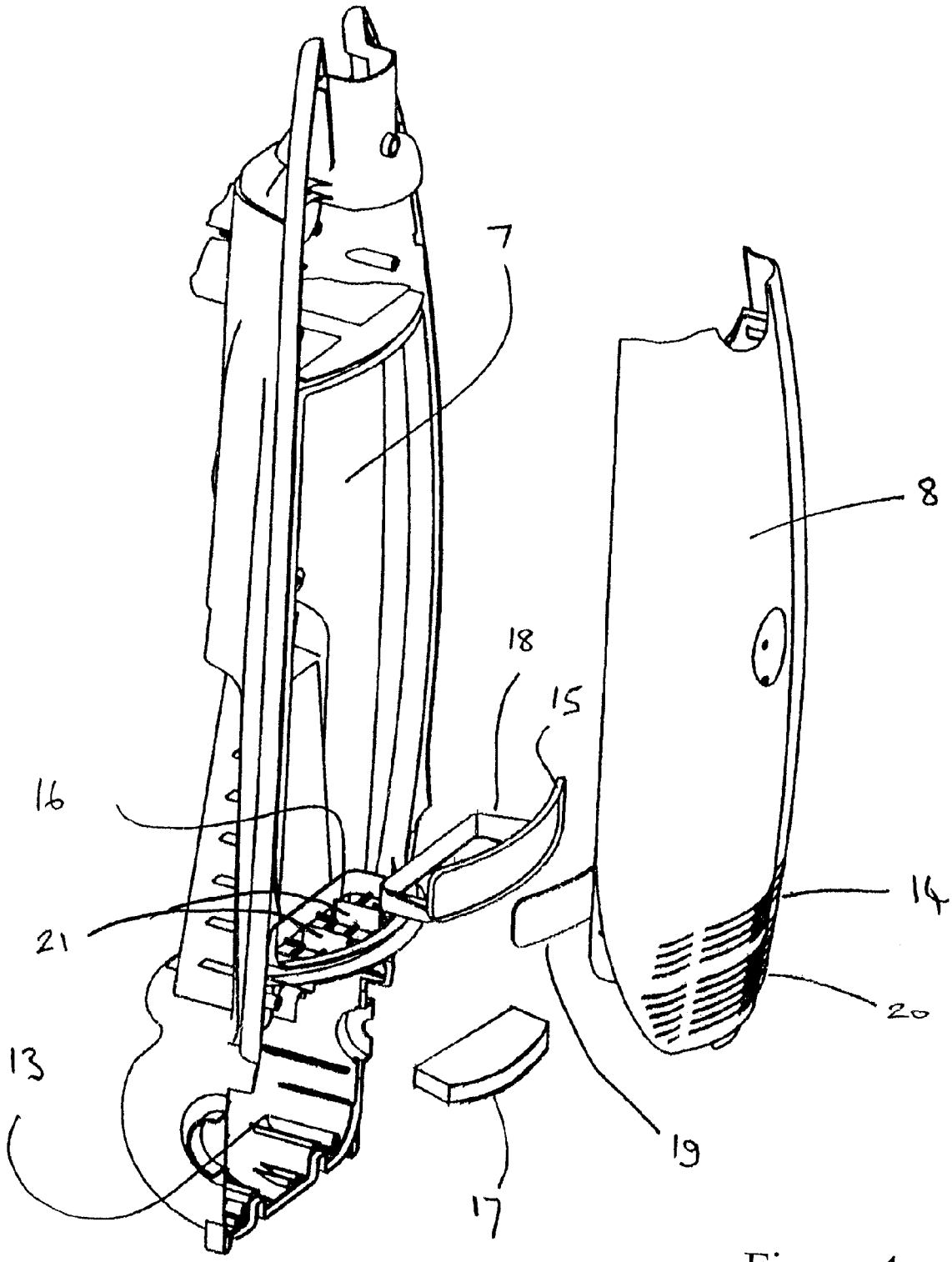
FIG. 4 is an exploded view of the main housing of an upright vacuum cleaner in accordance with the present invention.

FIG. 4 is a more detailed view, in exploded form, of the main housing of the cleaner in accordance with the present invention. It will be noted that the filter assembly 12 comprises a planar filter element 17, typically of foamed plastics material or a pleated polyethylene sheet, fixed into a frame member 18 of plastics material which, in use, rests on the grill 16 which forms the floor of the bag chamber 7. The upstanding wall 15 of the filter assembly is formed integrally with the frame 18 and its outer surface carries a pad 19 of resilient material, typically soft rubber. The filter element 17, frame 18 with upstanding wall 15 and resilient pad 19 thus form the filter assembly 12, which is removable as a unit from the cleaner for cleaning or renewal. It will be appreciated that when the filter assembly 12 is correctly installed and the cover 8 is in position closing the bag chamber 7, then the resilient pad 19 will rest in sealing contact against the inner surface of the cover 8, over the grill 14 formed in the lower region of the cover. Should the filter assembly be absent, the grill 14 will provide direct fluid communication between the bag chamber 7 and the atmosphere surrounding the cleaner, and negative pressure in the bag chamber, essential for effective operation of the cleaner, will not be set up.

In the embodiment shown in FIG. 4, the bag chamber cover 8 extends below the level of the floor of the bag chamber 7 and is formed with a second grill 20, below the grill 14: the grill 20 is however provided for aesthetic reasons only. Two ribs 21 may be provided, as shown, projecting upwards from the grill 16 of the bag chamber, for locating the filter assembly where this is modified to co-operate with such ribs.

It will be appreciated that the above-described vacuum cleaner incorporates a simple and inexpensive arrangement for providing a clear indication to the user in the event that the filter assembly being absent and accordingly preventing the fan and motor from being damaged by incoming dirt.

The invention claimed is:

1. A vacuum cleaner comprising:

a main separation stage comprising a chamber housing a separator for separating out dirt from airflow supplied to a separator inlet and passing along a first airflow path through the separator, the chamber having a first aperture as well as a second aperture separate and distinct from the first aperture;

the first aperture in fluid communication with a suction source for supplying suction to the chamber of the main separation stage;

the second aperture formed in a wall of the chamber and defining a second airflow path in fluid communication with ambient for intake of ambient air into the chamber, wherein the second airflow path bypasses the separator for supply of ambient air to the suction source; and a filter assembly, separate and distinct from the separator and removably disposed within the chamber in an installed configuration wherein the filter assembly is arranged to occlude said second aperture and thus block the second airflow path as well as provide a filtration stage between the main separation stage and the inlet of the suction source.

2. A vacuum cleaner according to claim 1, wherein:

said second aperture is arranged so that, in the absence of said removable filter assembly, the majority of the airflow entering into the vacuum cleaner does so through said second aperture and bypasses the separator.

3. A vacuum cleaner according to claim 1, wherein:

the separator comprises a filter bag for storing dirt separated from airflow passing therethrough.

4. A vacuum cleaner according to claim 1, wherein:

the removable filter assembly comprises a filter element supported by a supporting structure, wherein part of the supporting structure occludes said second aperture.

5. A vacuum cleaner according to claim 4, wherein:

the part of the support structure which occludes said second aperture comprises a projecting part of the filter assembly.

6. A vacuum cleaner according to claim 5, wherein:

the projecting part fits one of sealingly into and sealingly over said second aperture.

7. A vacuum cleaner according to claim 1, wherein:

said second aperture is formed in a detachable or hinged cover that defines said chamber.

8. A vacuum cleaner according to claim 1, wherein:

said second aperture is provided by a grill comprising an array of openings.

9. A vacuum cleaner according to claim 1, wherein:

the removable filter assembly is removably disposed within the cleaner so that when the removable filter is installed, air passes through the removable filter assembly as it passes from a suction nozzle or other such inlet and along an internal conduit of the cleaner, and when the removable filter is removed, air is drawn from ambient through said second aperture instead of being drawn from the suction nozzle or other such inlet and along said internal conduit.

10. A filter assembly for a vacuum cleaner according to claim 1, the filter assembly comprising a filter element for airflow passing therethrough, and a part arranged to occlude said second aperture of said vacuum cleaner.

11. A filter assembly according to claim 10, wherein:

said part of the filter assembly is provided with a sealing means for sealing around said second aperture.

12. A vacuum cleaner according to claim 1, wherein:

the wall of the second aperture is part of a removeable or hinged cover that defines said chamber.

13. A vacuum cleaner according to claim 1, wherein:

the separator has a bottom end opposite the separator inlet, and the second aperture is disposed vertically below the bottom end of the separator.

14. A vaccum cleaner according to claim 1, wherein:

the filter assembly can be removed from the installed configuration such that the second aperture is not occluded by the filter assembly and the second aperture defines the second airflow path for intake of ambient air into the chamber for supply of ambient air to the suction source while bypassing the separator.

* * * * *